United States Patent [19]

Anderson

[11] 4,074,882

[45] Feb. 21, 1978

[54] FLOWER POT SUPPORT HOLDER

[76] Inventor: John H. Anderson, 308 Canal St., R.F.D. No. 3, Brattleboro, Vt. 05301

[21] Appl. No.: 729,631

[22] Filed: Oct. 5, 1976

[51] Int. Cl.[2] ..... A47F 5/00

[52] U.S. Cl. ..... 248/208; 248/226.2

[58] Field of Search ..... 211/87; 248/208, 214, 248/215, 220.2, 225.3, 226.2

[56] References Cited

U.S. PATENT DOCUMENTS

| | | | |
|---|---|---|---|
| 934,676 | 9/1909 | Langslow | 248/226.2 X |
| 1,955,476 | 4/1934 | Torgersen | 248/208 |
| 2,539,935 | 1/1951 | Stephens et al. | 248/226.2 |
| 3,768,767 | 10/1973 | Dobkowski | 248/226.2 |

*Primary Examiner*—James C. Mitchell

*Attorney, Agent, or Firm*—Sughrue, Rothwell, Mion, Zinn and Macpeak

[57] ABSTRACT

An inverted L-shaped metal strip bracket member hangs from an upper window trim board or the like and has a plurality of vertically spaced elongated horizontal slots within the lower end permitting a second metal strip hanger bar to be insertably received within one of the slots with one portion facing inwardly of the bracket in contact with the bottom of the window frame while the other portion projects outwardly of the bracket for suspending a flower pot at its outer end.

2 Claims, 2 Drawing Figures

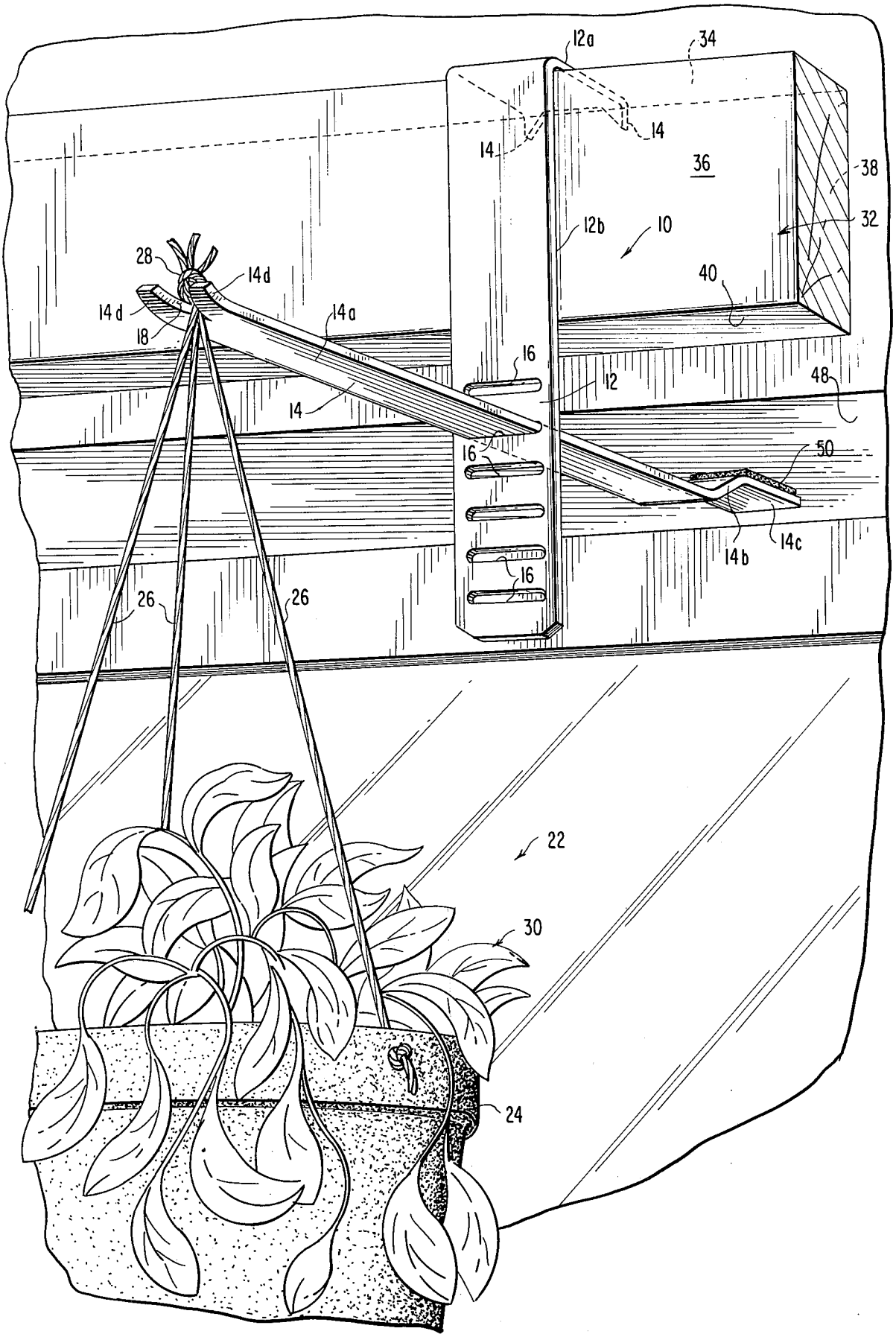
12a
34
14
14
36
38
32
12b
10
28
14d
14d
18
14a
40
16
12
48
14
16
50
14b
14c
16
26
26
22
30
24

FLOWER POT SUPPORT HOLDER

BACKGROUND OF THE INVENTION

1. Field of the Invention

This invention relates to a flower pot holder and more particularly to a simplified two-part structure permitting adjustability of a bracket to adjust to different widths of trim boards.

2. Description of the Prior Art

Attempts have been made to employ brackets or like members to support flower pots from window trim boards, windowsills or building walls or the like with the flower pots spaced laterally from the wall or from the window frame so as to prevent contact between the leaves of the plants overflowing the flower pot periphery and the wall in the area of its support. Such brackets for suspending flower pots or similarly hung devices comprise the subject matter of the following U.S. patents constituting the best known prior art with respect to the present invention:

U.S. Pat. No. 670,139 to Omev filed 1901
U.S. Pat. No. 1,067,748 to Mitchell filed 1913
U.S. Pat. No. 1,955,476 to Torgersen filed 1934
U.S. Pat. No. 2,128,596 to Redin filed 1938
U.S. Pat. No. 2,202,412 to York filed 1940
U.S. Pat. No. 2,698,048 to Schweizer filed 1954
U.S. Pat. No. 3,352,429 to Magnuson filed 1967

While the mounting brackets perform a suspending function with respect to the articles suspended thereby in the above-identified patents, and the devices are complicated, expensive to produce and allow adjustment horizontally for the suspended flower pots or other plants since the configuration and dimensional parameters of the flowers and plants suspended by such devices vary widely.

SUMMARY OF THE INVENTION

The present invention consitutes a simplified flower pot holder of two-part construction formed of metal strip material. A first elongated strip member is of inverted L-shaped form and includes a horizontal base portion and an integral depending vertical hanger portion at right angles thereto. The base portion terminates at the end remote from the depending portion in at least one integral lip portion which extends parallel to, and in the direction of the depending hanger portion to form a hook at the upper end of the first elongated strip member such that the bracket member may be hung on a transverse upper window trim board. A second elongated strip member has a width less than that of the first strip member. The first strip member includes a plurality of vertically spaced horizontal slots within its lower end of width and height slightly larger than the width and thickness of the second strip member and the second strip member is insertably carried within a given slot of the first strip member such that one portion projects rearwardly toward beneath the inner face of the window frame and a second portion projects outwardly from the first strip member with the second strip member incorporating means at its outboard end for suspending a flower pot therefrom.

The portion of the second strip member which underlies the window frame preferably terminates in an offset section projecting towards the bottom of the window frame and carries a pad on its upper surface to prevent marring of the bottom surface of the window frame with which it abuts. The outboard end of the second portion of the second strip member is preferably forked so as to readily receive the knotted ends of a number of cords whose other ends are individually fixed to the flower pot at circumferentially spaced positions, respectively.

BRIEF DESCRIPTION OF THE DRAWING

The single FIGURE is a perspective view of the improved flower pot holder of the present invention adjustable to different trim widths and supported on an upper window trim board from which a flower pot is suspended.

DESCRIPTION OF THE PREFERRED EMBODIMENT

Referring to the drawing, the flower pot holder of the present invention may be mounted to any horizontal relatively narrow planar member such as a beam or board of limited height such that a portion of the holder may project beneath the bottom surface of the beam or board upon which the holder is mounted.

Specifically, the flower pot holder indicated generally at 10, comprises a two-part assembly consisting of a first metal strip or bracket member 12 and a second metal strip or hanger bar member 14. The bracket member 12 is of inverted L-shaped configuration in vertical elevation and comprises a base portion **12*a* and an integral right angle depending hanger portion 12*b*. The base portion 12*a* terminates rearwardly, in the illustrated embodiment; that is, at its end remote from the hanger portion 12*b*, in a pair of laterally spaced triangular shaped integral projections 14 constituting a lip for the metal strip 12 which parallels hanger portion 12*b*. Further, the depending hanger portion 12*b* terminates at its lower end in a plurality of vertically spaced, elongated, narrow slots 16 which extend transversely or horizontally. The second metal strip or hanger bar member 14 is of a width slightly less than the length of an elongated slot 16 and of a thickness slightly less than the height of that slot so that the metal strip 14 can be inserted within a given slot 16 of the metal strip 12 to form a T-shaped assembly with a first portion 14*b* of strip 14 extending rearwardly of the bracket member 12 and a second portion 14*a* extending forwardly, that is away from the front face of member 12. The flower pot holder is preferably supported overlying a window frame trim as indicated by being hooked to a horizontally extending narrow trim board or beam 32. Beam 32 has an upper horizontal surface or edge 34, a front surface 36, a rear surface 38, and a bottom surface 40. The base upper end of the bracket member 12, its base 12*a* and lip projections 14 define a hook for that member which simply hooks over the upper edge of window trim beam 32 with the base flush with the upper surface 34 of that beam, the lip 14 contacting the rear surface 38 and the rear surface of the hanger portion 12*b* laying flush with or at least parallel to the front surface 36 of the window trim beam 32**.

Preferably, the portion of the hanger bar or second metal strip member 14 which extends rearwardly of the bracket member 12 is provided with an offset terminal section **14*c* jointed by an intermediate portion 14*b* to a main portion of member 14 such that the upper surface of portion 14*c* faces the bottom surface 48 of the beam or window frame 32. Further, it is preferred that a soft pad 50 be fixed to the upper surface of portion 14*c* of the hanger bar 14 so as to prevent marring of the bottom surface 48 of the window frame. The outwardly projecting portion 14***a* of the hanger bar 14 terminates in a V-shaped notch 18 defining forks 14*d*. The V-shaped notch 18 permits the knotted end 28 of a plurality of cords 26 to be lodged therein; the lower ends of the cords 26 being fixed to the perimeter of flower pot 24 at circumferentially spaced positions. The flower pot 24 contains appropriately, a plant indicated generally at 30, which overflows the flower pot. Because of the various lengths of the overflow portion of the plant which depends downwardly from the flower pot 24, the number of elongated slots 16 allows for different trim widths; also slots allow horizontal adjustment to move plant away from the window. Further, depending upon the vertical height of the window trim board or beam 32 or other horizontal member upon which the flower pot holder 10 is hung, the hanger bar 14 may have to be adjusted so as to permit the bar 14 to underlie the bottom of the horizontal member upon which the holder is hung.

Further, while both the two-part assembly 10 may be formed of metal strip material, it is obvious that the elements may be formed of molded plastic or the like, in strip form.

Although the flower pot holder described is most advantageous when used in the embodiment according to the invention, it can obviously be modified in various ways without departing from the scope of the invention and certain elements contained therein may be replaced by others capable of ensuring the same technical function or an equivalent technical function.

What is claimed is:

1. A height and laterally adjustable flower pot holder comprising:

a first elongated strip forming a unitary bracket member of inverted L-shaped configuration including a horizontal base portion, a vertical depending hanger portion at right angles thereto and integral therewith, said base portion terminating at an end remote from said depending hanger portion in at least one integral lip portion extending parallel to and generally in the direction of said depending hanger portion and thereby forming with said base and said depending hanger portion a hook for hooking the upper end of said bracket member over a horizontal window trim board or the like, a second elongated strip member defining a hanger bar and being of a width less than that of the first strip member, said first strip member including a plurality of vertically spaced horizontal, elongated slots within the lower end thereof of a width and height slightly larger than the width and thickness of said second strip member, said second strip member being longitudinally adjustably, insertably carried within a given slot of said first strip member with a first portion projecting rearwardly beneath said window frame and contacting the bottom of said frame and a second portion projecting horizontally outwardly of said first strip portion, and means for suspending a flower pot from the outboard end of said second portion of said second strip member, such that said second strip member is inserted within a given slot of said first strip member dependent on the vertical height of the horizontal window trim board and said second strip member is adjusted longitudinally within a selected slot to adjust the distance between the suspended flower pot and the horizontal window trim board to thereby permit suspending of various size flower pots.

2. The flower pot holder as claimed in claim 1, wherein said second strip member terminates in an offset section generally parallel to the portion of said second strip member projecting through said elongated slot, said offset section carrying a pad on its surface facing the bottom of said window frame for preventing marring of the bottom of the frame during contact therewith and wherein said second portion of said second strip member terminates at its outboard end in a V-shaped notch for receiving commonly knotted ends of a plurality of cords whose other ends are coupled to the flower pot at circumferentially spaced positions respectively.

* * * * *